US005170138A

United States Patent [19]

Roberts et al.

[11] Patent Number: 5,170,138

[45] Date of Patent: * Dec. 8, 1992

[54] SINGLE TOROID HYBRID MODE RF PHASE SHIFTER

[75] Inventors: Roger G. Roberts, Auburn; Thomas E. Sharon, Alpharetta, both of Ga.

[73] Assignee: Electromagnetic Sciences, Inc., Norcross, Ga.

[ * ] Notice: The portion of the term of this patent subsequent to Dec. 24, 2008 has been disclaimed.

[21] Appl. No.: 669,959

[22] Filed: Mar. 15, 1991

Related U.S. Application Data

[63] Continuation-in-part of Ser. No. 330,617, Mar. 30, 1989, Pat. No. 5,075,648.

[51] Int. Cl.[5] ..... H01P 1/195

[52] U.S. Cl. ..... 333/24.1; 333/33

[58] Field of Search ..... 333/21 R, 24 C, 24.1, 333/33, 157, 158

[56] References Cited

U.S. PATENT DOCUMENTS

| | | | |
|---|---|---|---|
| 2,894,216 | 7/1959 | Crowe . | |
| 3,408,597 | 10/1968 | Heiter | 333/24.1 |
| 3,425,003 | 1/1969 | Mohr . | |
| 3,471,809 | 10/1969 | Parks et al. . | |
| 3,524,152 | 8/1970 | Agrios et al. | 333/24.1 |
| 3,539,950 | 11/1970 | Freibergs . | |
| 3,585,536 | 6/1971 | Braginski | 333/24.1 |
| 3,599,121 | 8/1971 | Buck | 333/24.1 |
| 3,656,179 | 4/1972 | De Loach . | |
| 3,758,886 | 9/1973 | Landry et al. | 333/21 R |
| 3,838,363 | 9/1974 | Schilz | 333/24.1 |
| 3,849,746 | 11/1974 | Mason et al. | 333/24.1 |
| 3,952,267 | 4/1976 | Dischert | 333/24.1 |
| 3,986,149 | 10/1976 | Harris et al. | 333/1.1 |
| 4,001,733 | 1/1977 | Birch et al. | 333/1.1 |
| 4,349,790 | 9/1982 | Landry | 333/24.1 |
| 4,405,907 | 9/1983 | Breese et al. | 333/24.1 |
| 4,434,409 | 2/1984 | Green | 333/24.1 |
| 4,445,098 | 4/1984 | Sharon et al. | 333/1.1 |
| 4,679,249 | 7/1987 | Tanaka et al. | 455/328 |
| 4,745,377 | 5/1988 | Stern et al. | 333/26 |
| 4,816,787 | 3/1989 | Stern et al. | 333/158 |
| 4,881,052 | 11/1989 | Stern et al. | 333/24.1 |
| 5,075,648 | 12/1991 | Roberts et al. | 333/24.1 X |

*Primary Examiner*—Paul Gensler

*Attorney, Agent, or Firm*—Nixon & Vanderhye

[57] ABSTRACT

A miniaturized waveguide mode ferrite RF phase shifter is efficiently transitioned to a matched impedance microstrip transmission line mode at either end to result in an ultra small, efficient and lightweight essentially "planar" phase shifter device having a single ferrimagnetic toroid.

30 Claims, 2 Drawing Sheets

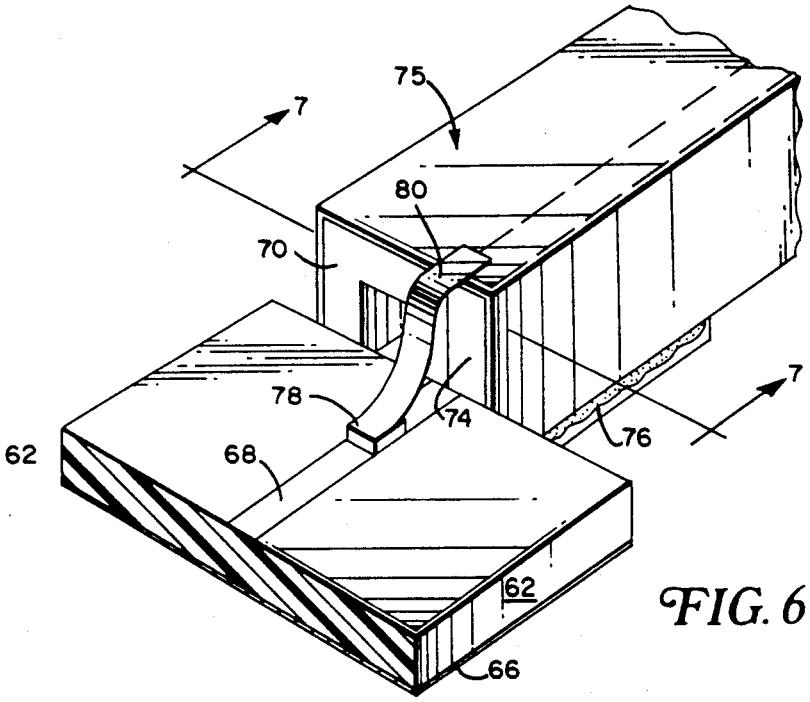
FIG. 6
FIG. 7
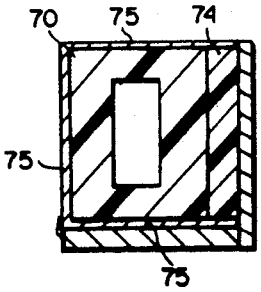
FIG. 8
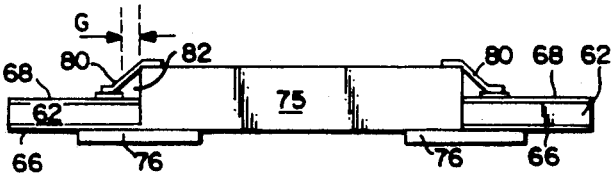

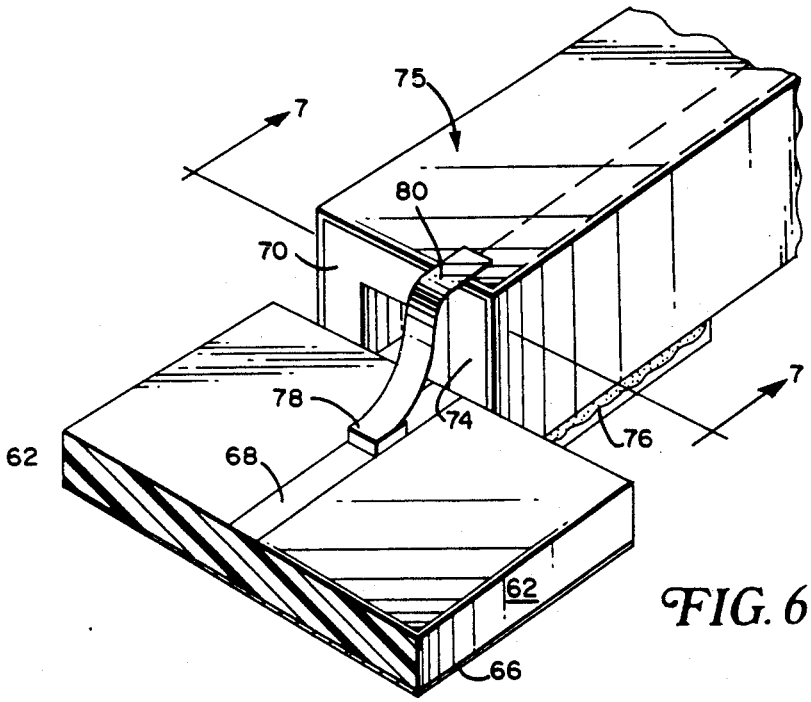
FIG. 6
FIG. 7
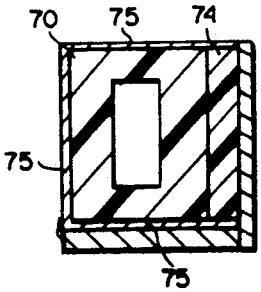
FIG. 8
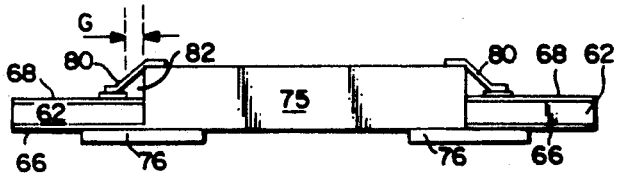

SINGLE TOROID HYBRID MODE RF PHASE SHIFTER

This application is a continuation-in-part of Ser. No. 07/330,617 filed Mar. 30, 1989 and issued on Dec. 24, 1991 as U.S. Pat. No. 5,075,648.

FIELD OF THE INVENTION

This invention relates generally to controllable RF phase shifters. It is particularly concerned with very high performance yet extremely small-sized phase shifters especially useful in phased RF radiator arrays at higher RF frequencies where available space between arrayed radiator elements is quite limited and essentially "planar" microstrip circuits are most effectively utilized. The invention has special utility for realizing small size phasers, switches, polarization networks and the like in the microwave industry.

RELATED APPLICATIONS

This application is related to the following copending commonly assigned patent applications (the contents of which are incorporated by reference):

Roberts, Ser. No. 07/330,638, filed Mar. 30, 1989, "Reciprocal Hybrid Mode RF Circuit For Coupling RF Transceiver To An RF Radiator" (now U.S. Pat. No. 5,129,099).

Roberts et al., Ser. No. 07/330.617, filed Mar. 30, 1989, "Hybrid Mode RF Phase Shifter" (now U.S. Pat. No. 5,075,648).

BACKGROUND BRIEF DESCRIPTION OF THE INVENTION

Ideally, a controllable RF phase shifter should have minimum size, minimum insertion loss, minimum weight, minimum cost and complexity, substantial immunity from all adverse ambient environmental factors (including physical and electrical) and an ability to produce any desired phase shift accurately and instantly upon demand. Unfortunately, in spite of many years of effort by those in the art, the truly ideal phase shifter has yet to be realized.

A waveguide mode twin slab ferrite phase shifter (e.g. of the type described in commonly assigned U.S. Pat. No. 4,445,098—Sharon et al.) is one of the most accurate phase shifters known to date. However, in prior realizations. Such waveguide mode phase shifters are large and expensive. If unswitched reciprocity is desired, this waveguide unit used in conjunction with circulators is too large for two dimensional phased arrays (where inter-radiator dimensions on the order of 0.6 wavelength are involved).

The Sharon et al. type of dual toroid ferrite phase shifter has been greatly miniaturized and incorporated serially with a microstrip transmission line to produce a novel, ultra-miniaturized, essentially planar, phase shifter of superior structure and performance. A miniaturized dual toroid phase shifter is disclosed in the application entitled "Hybrid Mode Phase Shifter" identified above.

There has been a need for a miniaturized single toroid phase shifter. Accordingly, we have successfully converted the miniaturized dual toroid phase shifter into a single toroid phase shifter Some of the advantages that the single toroid phase shifter has over the dual toroid phase shifter are that it is less complex, more economical to produce and more compact.

The present invention may, in some respects, be described as a single toroid, side slab miniaturized waveguide phase shifter inserted serially between interrupted matched-impedance microstrip transmission lines. Some embodiments may position the waveguide portion into an underlying ground plane structure while others dispose at least a portion of the waveguide above the top level of a microstrip substrate. In a presently preferred embodiment, the waveguide portion is butted between terminated ends of the microstrip substrate so that the maximum thickness of the whole device is merely that of the central waveguide portion.

BRIEF DESCRIPTION OF THE DRAWINGS

FIG. 1 is a perspective bottom view of a first exemplary embodiment of the invention in which matched serial couplings are achieved by probes attached directly to microstrip transmission lines terminating and leading to the dielectric ends of a serially imposed waveguide phase shifter;

FIG. 2 is a perspective view of the metal end cap shown in FIG. 1;

FIG. 3 is a top view of FIG. 1;

FIG. 4 is a cross-sectional depiction of one end of the device along line 4—4 in FIG. 3 illustrating the pin-type microstrip phase shifter coupling;

FIG. 5 is an approximate equivalent RF circuit of the microstrip and waveguide transmission media arrangement of FIG. 1;

FIG. 6 is a perspective view of a presently preferred exemplary embodiment of this invention in which matched couplings between a waveguide phase shifter and abutting microstrip transmission line sections at either end is attained by a capacitance and metal ribbon;

FIG. 7 is an end view of the invention along line 7—7 in FIG. 6, and FIG. 8 is a side view of the invention shown in FIG. 6.

DETAILED DESCRIPTION OF EXEMPLARY EMBODIMENTS OF THE INVENTION

In the perspective view of FIG. 1, a parallel, elongated, rectangular ferrimagnetic toroid 2 has a slab 6 of high dielectric material affixed adjacent to one of its sides and metallized surfaces 8 on the outer sides of the composite toroid/slab structure to form a miniature waveguide internally thereof. A dielectric substrate 18, which also may be made of a ferrimagnetic material, has a metallized ground plane surface 20 on the side shown in FIG. 1 as soldered to the metallized surfaces 8. Conductive microstrip lines 22 and 24 on the opposite side of substrate 18 are shown in dashed lines. They extend to or a little bit beyond the ends of the toroid 2 so to permit connection to a mode transition pin or probe 32 located at each end of the toroid/slab.

Although only one end of the toroid 2 is visible in FIG. 1, the other end is the same. An aperture 30 in the metallized ground plane surface 20 extends, as better seen in FIG. 4, through the substrate 18 at a location adjacent the end of the dielectric slab 6. A metal probe 32 is mounted on and electrically connected to the microstrip line 22. It extends through the aperture 30 without touching the metallized surface 20. The probe stands upright through the ground plane such that its axis aligns approximately with the junction between the toroid and slab. About one-half of the probe is in front of a wall of the toroid and the other half is in front of the slab. Routine experimentation is necessary to optimally align the probe in front of the toroid/slab.

An L-shaped wire guide 34 is made of dielectric material and shaped with arm 38 that can be respectively inserted into the center space of toroid 2. Groove 42 on the outer side of the arm 38 provides an ingress/egress passage for latching current wire 44. When the wire guide 34 is mounted in position, its base or bight 48 bears against the probe 32 as shown in FIG. 4.

As shown in FIGS. 1 and 2, a metal end cap 50 is designed to fit around the wire guide 34 and is soldered to the metallized surface 20 as well as to the metallized surfaces 8 along the tops and outer sides of the toroid 2 to complete an end for the waveguide mode structure. An end cap 50 at the other end of the toroid is mounted as just described. The resulting cavity housing assists in tuning the probe transition to a matched impedance condition.

In the top view of FIG. 3, the microstrip lines 22 and 24 are seen to provide a microstrip transmission line serially interrupted by the connection of the waveguide phase shifter via mode transmission probes 32. The bottoms of the solder connections 35 are just visible in FIG. 3. Miniature coaxial transmission line connectors can easily be connected to a short length of the microstrip 22 or 24 (thus providing a highly compact coax-microstrip-waveguide-microstrip-coax RF mode sequence). Many possible alternate combinations and permutations are possible by omitting some of the modes from one or both ends. Thus, an overall coax-to-microstrip or microstrip-to-coax mode phase shifter device can be realized.

FIG. 4 shows the structure at the end of the toroid 2. The metal end cap 50 is soldered to the metallized surfaces 8 and to the metallized ground plane surface 20. Base 48 of the L-shaped wire guide is seen in section. The bottom of probe 32 is soldered 35 to microstrip line 22, and epoxy 52 is deposited along the line of contact between probe 32 and the end of the slab/toroid junction.

FIG. 5 is an approximate equivalent circuit for the matched coupling between microstrip mode lines 22, 24 and the waveguide mode phase shifter (i.e. the toroid 2, slab 6 and the metallized surfaces 8). The beyond cutoff waveguide cavity is represented by shunt inductance 54, and the capacitance coupling provided by gap G between the distal end of a probe 32 and the opposite end cap 50 is represented by shunt capacitance 56. Capacitances 58 and 60 represent series capacitances associated with the probe.

Thus, the single toroid design, as shown in FIGS. 1-5 includes a toroid 2 adjacent a slab of high dielectric material 6 ($\epsilon'=80$). The high dielectric slab 6 functions similarly to a dielectric center core in any other single toroid. Additionally, the slab provides a thermal path to remove heat from the toroid generated by RF power dissipation. The toroid and slab are secured together (e.g. epoxy) and metallized. The RF fields are thus concentrated towards the slab side of the toroid.

The most RF-active ferrite is located on the side of the toroid adjacent the dielectric slab. The other side of the toroid is relatively inactive and serves merely to complete a magnetic path and allow latching operations (as is explained more fully in Sharon et al). This other side of the toroid decreases the efficiency (differential phase per unit length) of the phase shifter, because the dielectric material (the ferrite) at the waveguide walls is magnetized in a direction to subtract from the primary differential phase shift obtained by the wall adjacent the slab. This effect is minimized by using a high dielectric slab.

A unique transition impedance matching scheme is used in FIGS. 1-5 to match the single toroid waveguide phase shifter section to the RF input and output microstrip transmission line structures. This matching technique may possibly be explained by considering the boundary between the toroid loaded waveguide structure and waveguide (operated beyond cutoff) cavity section. The boundary at the toroid and cavity section looks like a shunt inductance. The probe 32 protruding from the microstrip line appears as a shunt capacitance and a small series capacitance (as shown in the equivalent circuit of FIG. 5). The distance from the back plane of the cavity to the probe (i.e. space occupied by section 48 of the L-shaped dielectric member 34) and the probe gap distance G to the opposite side of the waveguide changes the shunt capacitance. Variable match-tuning capacitance, once the probe depth is fixed, is achieved from back plane adjustment of end caps 50. This technique permits broad frequency operation because the matching occurs, for all practical purposes, in the same plane as the impedance discontinuity.

The return loss was measured over the frequency band of 9.575 to 10.46 GHz. The return loss was a minimum of approximately 15 dB over the frequency band. The return loss was limited due to the OSM to microstrip adapters at each end. From measurements made on a straight section of microstrip 50 ohm line with the OSM to microstrip connectors, it has been calculated that the hybrid mode phase shifter has a return loss greater than 23 dB over the same frequency band.

Another preferred embodiment of the invention is illustrated in FIGS. 6-8. A microstrip line 68 is butted against a toroid end 70. The exposed sides of the toroid as well as the top and bottom of the high dielectric slab 74 are metallized 75 to form a miniaturized rectangular waveguide.

The metallized lower ground plane surface 66 of the microstrip structure makes electrical contact with the lower metallized surface 75. Mechanical rigidity as well as good electrical contact is provided by soldering a metal plate 76 (or plated dielectric substrate) to the metal ground plane surface 66 (at one end) and to an abutting lower end portion of the metallized surface 75.

The height of the microstrip dielectric 62 (e.g. about 0.055 inch) is less than the height of the toroid 70 (e.g. about 0.100 inch) so that the microstrip 68 butts against slab 74 at a point near its vertical center. The microstrip line is about 0.030 inch wide and 0.0002 inch thick. The microstrip is aligned in a horizontal direction such that its axis is approximately centered on the junction between the slab and toroid wall. The optimal position of the strip with respect to the slab/toroid junction is used as a tuning mechanism. One side of a capacitance 78 (e.g. a chip capacitor) is mounted in electrical contact with the microstrip line 68, and a metal ribbon 80 (e.g. gold bonding ribbon 0.025 inch wide and 0.001 inch thick) is suspended in electrical contact (e.g. by soldering) between the other side of the capacitance 78 and a location on the top metallized surface 75 that is immediately above slab 74. In the alternative, the ribbon 80 can be conductively attached to the microstrip line 68 and capacitively coupled to the metallized surface 75 adjacent to the slab 74. As better seen in the side view of FIG. 8, ribbon 80 may form a roughly triangular opening 82. An identical mode transition structure at the other end of the toroid is generally shown in FIG. 8.

The gap dimension G between the ribbon 80 and the dielectric slab 74 is a tuning mechanism to impedance match between the microstrip transmission line and the phase shifter. Exact values for a given design are best obtained by routine experimentation. G is not a critical parameter. For instance, when the dielectric substrate is positioned co-planar with the top of the phase shifter, G becomes zero.

At a frequency of about 6 to 11 GHz, good operating results have been attained with the chip capacitor 78 (e.g. simply a suitable length of ribbon 80 insulated from microstrip line 68 by dielectric tape which results in a capacitance of about 0.3 pf), a mean gap distance G between the ribbon and the end of the slab 74 of about 0.015 to 0.40 inch and a height of the slab 74 above the microstrip 68 of about 0.050 inch.

In the FIGS. 6–8 technique for achieving the microstrip to ferrite toroid transition, as earlier stated, one key element of the matching technique is the realization of a series capacitive element in the microstrip line to toroid connection.

The transition shown in FIGS. 6–8 is capable of achieving a low insertion loss and a good impedance match. The assumed principle of operation can be explained in terms of an equivalent one stage LC ladder circuit. Here, a shunt ladder inductance represents the shunt inductance of the basic microstrip to toroid junction. The capacitance is chosen to represent the required impedance for impedance matching between the microstrip and toroid waveguide characteristic impedances.

While only a few exemplary embodiments of this invention have been described in detail, those skilled in the art will recognize that many variations and modifications may be made in these examples while yet retaining many of the novel features and advantages of this invention. All such variations and modifications are intended to be included within the scope of the appended claims.

What is claimed is:

1. A radio frequency phase shifter comprising:

a latching RF phase shifter having just one ferrimagnetic toroid with a conductive latch wire and a dielectric slab disposed along a longitudinal axis between opposite ends of a conductive waveguide, said toroid and said slab being asymmetrically mounted with said waveguide;

said phase shifter being disposed serially with a microstrip RF transmission line via an impedance-matched transition located adjacent at least at one of the ends of said waveguide, said transition being effected without extending into a toroid wall.

2. A radio frequency phase shifter as in claim 1, wherein:

said conductive waveguide being formed by metallization of the outermost surfaces of the composite toroid/slab structure; and said conductive latch wire being threaded through the open center of the toroid for use in setting remnant magnetic flux within said toroid to predetermined values.

3. A radio frequency phase shifter as in claim 1, wherein each of said impedance-matched transitions comprise:

a conductive link capacitively coupled between said microstrip line and said waveguide at a point proximate the junction between said dielectric slab and toroid.

4. A radio frequency phase shifter as in claim 3, wherein:

said conductive link includes a ribbon member capacitively coupled at one end to said microstrip line and conductively coupled at its other end to said waveguide.

5. A radio frequency phase shifter as in claim 3, wherein:

said waveguide is disposed with its ends between abutting ends of dielectric substrates having first conductive ground plane surfaces and second surfaces with said microstrip transmission line formed thereon;

said first conductive ground plane surfaces of the substrates being conductively coupled with each other and with one side of said abutting waveguide ends;

said substrates being of lesser thickness than said waveguide; and said conductive link defining a predetermined gap G between it and the exposed respective end of said dielectric slab.

6. A radio frequency phase shifter as in claim 5, wherein:

said conductive link includes a ribbon member capacitively coupled at one end to said microstrip line and conductively coupled at its other end to said waveguide.

7. A radio frequency phase shifter as in claim 5, wherein said gap G is of approximately triangular shape.

8. A radio frequency phase shifter as in claim 6, including a discrete chip capacitor affixed to each microstrip transmission line at a predetermined distance away from said junction between the slab and toroid.

9. A radio frequency phase shifter as in claim 8, wherein each said capacitor has a capacitance of approximately 0.3 pf.

10. A radio frequency phase shifter comprising:

a latching RF phase shifter having just one ferrimagnetic toroid with a conductive latch wire and a dielectric slab disposed along a longitudinal axis between opposite ends of a conductive waveguide, said toroid and said slab having axes offset from the axis of said waveguide;

said phase shifter being disposed serially with a microstrip RF transmission line via an impedance-matched transition located adjacent at least at one of the ends of said waveguide, said transition being effected without extending into a toroid wall, said transition having a conductive probe extending perpendicularly from a terminate end of said microstrip transmission line along and in contact with a respective end of said dielectric slab.

11. A radio frequency phase shifter as in claim 10, further comprising:

a conductive end cap conductively connected to each end of said waveguide, said end caps enclosing the probe at each end of the waveguide and defining dimensioned capacitive gaps between the probe and end cap for use in achieving matched impedance transitions between waveguide and microstrip RF modes.

12. A radio frequency phase shifter as in claim 11, further comprising:

an L-shaped dielectric spacer located at each end of the waveguide with its leg extending longitudinally into the waveguide and its bight portion being disposed between a respective probe and end cap.

13. A hybrid mode RF phase shifter comprising:

a latching conductive waveguide phase shifter having just one ferrimagnetic toroid with a conductive latch wire and a dielectric slab, said toroid and said slab extending longitudinally between two ends of said waveguide phase shifter, said toroid and said slab being asymmetrically mounted in said waveguide;

a first microstrip line;

a first impedance matched coupling between said first microstrip line and one end of said waveguide phase shifter, said first coupling being effected without extending into a toroid wall;

a second microstrip line; and a second impedance matched coupling between said second microstrip line and the other end of said waveguide phase shifter, said second coupling also being effective without extending into a toroid wall.

14. A hybrid mode RF phase shifter comprising:

a dielectric substrate having a conductive ground plane surface on one side;

a latching waveguide phase shifter having metallized surfaces affixed to said ground plane surface and having just one ferrimagnetic toroid with a conductive latch wire extending longitudinally and a dielectric slab, said toroid and said slab extending between two ends of said waveguide phase shifter, said toroid and said slab having axes offset from the axis of said waveguide phase shifter;

apertures extending through said ground plane conductive surface and said substrate beyond and adjacent the ends of said waveguide phase shifter;

conductive microstrip transmission line disposed on the other side of said substrate respectively terminating at said apertures; and a conductive probe extending through each of said apertures beyond and adjacent the ends of said phase shifter and electrically connected, respectively, to the conductive microstrip transmission lines terminating thereat so as to effect matched impedance RF couplings between the microstrip transmission lines and phase shifter, said couplings not extending into the walls of said toroid.

15. A hybrid mode RF phase shifter as in claim 14, wherein each probe is mounted in substantial alignment with the junction between the slab and toroid.

16. A hybrid mode RF phase shifter as in claim 14, further comprising:

metal end caps respectively affixed to said conductive ground plane surface and to the metallized surfaces of said waveguide to conductively enclose said conductive probes and assist in establishing matched impedance coupling capacitances between said probes and the waveguide phase shifter.

17. A hybrid mode RF phase shifter as in claim 16, further comprising:

L-shaped dielectric wire guides respectively mounted between said end caps and said probes.

18. A hybrid mode RF phase shifter as in claim 16, wherein said probes are disposed perpendicular to said substrate and extend to a predetermined distance from said end caps to establish a gap G determinative, at least in part, of said coupling capacitances.

19. A hybrid mode RF phase shifter comprising:

a substrate of dielectric material;

a metallized surface on one side of said substrate;

just one axially-elongated, ferrimagnetic toroid mounted on said metallized surface;

a slab of dielectric material mounted adjacent a longitudinal side of said toroid;

a metal covering on the exposed surfaces of said toroid and slab, said metal covering being in electrical contact with said metallized surface, said metal covering having an axis offset from the axes of said toroid and said slab;

apertures in said metallized surface and in said substrate respectively substantially adjacent opposite ends of the junctions between slab and toroid;

separate metal microstrip transmission lines formed on one side of said substrate opposite said metallized surface, said lines respectively terminating at said apertures;

conductive probes respectively mounted in electrical contact with the terminations of said lines and extending through said apertures adjacent the ends of said junction of slab and toroid; and an electrical current conductor respectively extending axially through said toroid.

20. A hybrid mode RF phase shifter comprising:

a rectangular waveguide phase shifter having just one ferrimagnetic toroid, a dielectric slab mounted adjacent said toroid, and a metal outer surface on the toroid and slab, the axes of said toroid and said slab being symmetrical to the axis of said metal outer surface;

a pair of planar dielectric substrates, one surface of each of which is conducting and the other surface having narrow conductive strips, the height of each of said substrates being less than the height of said waveguide phase shifter;

said substrates being disposed in abutting relationship with opposite ends of said waveguide phase shifter with their conducting surfaces electrically connected to the metal outer surface of said rectangular waveguide phase shifter at one side of the phase shifter;

capacitance elements respectively mounted on the narrow conductive strips of said substrate at locations spaced from respective ends of the waveguide phase shifter; and conductive ribbons respectively suspended between said capacitance elements and the metal outer surface of said waveguide phase shifter that is displaced therefrom.

21. A hybrid mode RF phase shifter as in claim 20, wherein:

said conductive ribbons are in contact with said metal outer surface.

22. A hybrid mode RF phase shifter comprising:

just one ferrimagnetic toroid having a rectangular cross section;

a slab of dielectric material in electrical contact with said toroid, one side of said slab being adjacent one side of said toroid;

a conductive surface on the outer sides of said toroid and slab, the axis of said conductive surface being offset from the axes of said toroid and said slab;

two microstrip transmission lines, each including a planar dielectric substrate, one surface of which is conducting and the other surface having a narrow conductive strip thereon, the thickness of said substrate being less than the thickness of said toroid;

said microstrip transmission lines being in abutting relationship with opposite ends of said toroid;

capacitance elements respectively mounted on said narrow conductive strip of said microstrip transmission lines spaced from the ends of said toroid; and conductive ribbon suspended between said capacitance elements and a conductive surface.

23. A hybrid mode RF phase shifter as in claim 22 wherein the conductive ribbon is conductively attached to the narrow conductive strip of said microstrip and capactively coupled to a conductive surface of waveguide substantially adjacent the junction between the toroid and slab.

24. A radio frequency phase shifter comprising:

an RF phase shifter having a dielectric slab disposed along a longitudinal axis between opposite ends of a conductive waveguide;

said phase shifter being disposed serially with a microstrip RF transmission line via an impedance-matched transition located at least at one of the ends of said waveguide; and said RF phase shifter including just one axially elongated ferrimagnetic toroid with said dielectric slab affixed to one side of the toroid, said conductive waveguide being formed by metallization of the outermost surfaces of the composite toroid/slab structure, the axes of said toroid and said slab being offset from the axis of said waveguide; and a conductive latch wire being threaded through the open center of the toroid for use in setting remnant magnetic flux within said toroid to predetermined values;

said impedance-matched transition comprising a conductive link capactively coupled between said microstrip line and said waveguide at a point substantially proximate the junction between the toroid and slab.

25. A radio frequency phase shifter as in claim 24, wherein:

said conductive link includes said ribbon member capacitively coupled at one end to said microstrip line and conductively coupled at its other end to said waveguide.

26. A radio frequency phase shifter as in claim 24, wherein said waveguide is disposed with its ends between abutting ends of dielectric substrates having first conductive ground plane surfaces and second surfaces with said microstrip transmission line formed thereon;

said first conductive ground plane surfaces of the substrates being conductively coupled with each other end with one side of said abutting waveguide ends;

said substrates being of lesser thickness than said waveguide; and said conductive link defining a predetermined gap G between it and the exposed respective ends of the slab and toroid.

27. A radio frequency phase shifter as in claim 26, wherein:

said conductive link includes a ribbon member capacitively coupled at one end to said microstrip line and conductively coupled at its other end to said waveguide.

28. A radio frequency phase shifter as in claim 26, wherein said gap G is of approximately triangular shape.

29. A radio frequency phase shifter as in claim 27, including a discrete chip capacitor affixed to each microstrip transmission line at a predetermined distance away from the slab and toroid.

30. A radio frequency phase shifter as in claim 29, wherein each said capacitor has a capacitance of approximately 0.3 pf.

* * * * *